US006616105B2

(12) United States Patent
Grunwald et al.

(10) Patent No.: US 6,616,105 B2
(45) Date of Patent: Sep. 9, 2003

(54) RAIL SWITCH LOCK FOR POINTS TONGUES

(75) Inventors: Dieter Grunwald, Bad Essen (DE); Jens Böcker, Norderstedt (DE)

(73) Assignee: Schreck-Mieves GmbH, Dortmund (DE)

( * ) Notice: Subject to any disclaimer, the term of this patent is extended or adjusted under 35 U.S.C. 154(b) by 0 days.

(21) Appl. No.: 09/936,490

(22) PCT Filed: Dec. 29, 2000

(86) PCT No.: PCT/EP00/13318

§ 371 (c)(1),
(2), (4) Date: Dec. 20, 2001

(87) PCT Pub. No.: WO01/51332

PCT Pub. Date: Jul. 19, 2001

(65) Prior Publication Data

US 2002/0157561 A1 Oct. 31, 2002

(30) Foreign Application Priority Data

Jan. 11, 2000 (DE) ..... 100 00 804

(51) Int. Cl.[7] ..... E01B 7/00
(52) U.S. Cl. ..... 246/430; 246/448
(58) Field of Search ..... 246/415 R, 430, 246/435 R, 438, 448

(56) References Cited

U.S. PATENT DOCUMENTS 5,195,703 A * 3/1993 Kais et al. ..... 246/443
5,222,700 A * 6/1993 Kais et al. ..... 246/443
5,509,626 A * 4/1996 Fodor ..... 246/453
5,628,480 A * 5/1997 Vrsecky et al. ..... 246/453

FOREIGN PATENT DOCUMENTS

| | | |
|---|---|---|
| DE | 104695 | 4/1898 |
| DE | 312449 | 2/1918 |
| DE | 367285 | 4/1922 |
| DE | 43 24 883 | 2/1995 |
| DE | 195 02 105 | 7/1996 |
| DE | 196 15 196 | 10/1997 |
| EP | 0 645 295 | 9/1994 |
| EP | 0 723 901 | 7/1996 |
| FR | 550 064 | 1/1923 |
| WO | 95 03199 | 2/1995 |
| WO | 00 02759 | 1/2000 |

* cited by examiner

*Primary Examiner*—S. Joseph Morano
*Assistant Examiner*—Robert J. McCarry, Jr.
(74) *Attorney, Agent, or Firm*—Collard & Roe, P.C.

(57) ABSTRACT

This invention relates to a switch lock for switch tongues (2, 3) having at least one locking piece (6, 7) for attaching to a stock rail (4, 5), having at least one switch tongue attachment (8, 9) for attaching to a switch tongue (2, 3) and having a slide rod (10), wherein the adjustment distance of the slide rod (10) is greater than the switch tongue impact (Z) of the switch tongues (2, 3), and in its end position, the switch tongue (2, 3) is locked on the stock rail (4, 5), wherein at least one bearing roller (17, 18) is provided on the locking piece, and wherein the slide rod (10) can be moved relative to the locking piece (6, 7) by means of the bearing rollers (17, 18) to adjust the switch tongue (2, 3).

12 Claims, 6 Drawing Sheets

RAIL SWITCH LOCK FOR POINTS TONGUES

CROSS REFERENCE TO RELATED APPLICATIONS

Applicants claim priority under 35 U.S.C. §119 of German Application No. 100 00 804.6 filed Jan. 11, 2000. Applicants also claim priority under 35 U.S.C. §120 of PCT/EP00/13318 filed Dec. 29, 2000. The international application under PCT article 21(2) was not published in English.

BACKGROUND

This invention relates to a switch lock according to the features described in the preamble of claim 1.

Various types of switch locks are already known from practice, such as hook locks, clamp locks, inside locks and latch locks. A common factor in all types of switch locks is the fact that they operate the switch tongues in changeover operation. The switch lock here ensures that the switch tongues are held in their final positions, namely with the closed switch tongue held so that a wheel flange cannot enter between the stock rail and the closed switch tongue, and the open switch tongue held so that the distance between the stock rail and the open switch tongue guarantees that the wheel flange can run through it without being hindered. Additional requirements and properties of the switch lock usually include the fact that the switch lock

- includes a lock to prevent a gap between the stock rail and the switch tongue;
- holds the switch tongue and stock rail on the lower flange of the rail even when the track gauge widens, so that the defined switch tongue gap is not exceeded;
- permits longitudinal expansion of the switch tongue up to ±25 mm without any negative effect on secure locking;
- can be used for electrically controlled switches as well as manual and trailable switches;
- can be driven on at speeds up to 40 km/h;
- can also be used together with a non-drivable switch operating mechanism;
- can be used as a center lock for long switch tongues in high-speed switches;
- fits all the usual Vignol rail profiles;
- will function even in a dirty environment, snow drifts and ice, and
- can be installed between two railroad ties or in a hollow railroad tie.

The latch lock is one type of switch lock that is often used in practice. The latch lock consists of a slide rod, a connecting strap, two locking latches, two switch tongue attachments and two locking pieces. The locking latches are installed in the switch tongue attachments which are fastened to the switch tongues. The locking pieces clamped onto the stock rails serve as a support for the slide rod. This construction allows migration of the switch tongue in the case of a thermally induced length change of ±25 mm. The lateral guidance of the slide rod is taken over by the switch tongue attachment. The locking latch is mounted with an eccentric bolt which allows for play in the switch tongue to be adjusted. The impacts caused by high forces acting on the latch axis are absorbed in a built-in elastic bushing. The slide rod has two slide rod parts which are electrically insulated in the middle, so that no short-circuit is caused with a built-in track direct current circuit. The drive rod usually acts in the middle, but a lateral action is also possible.

The following applies with regard to the mode of functioning for switch changeover of the lock. The locking latch, connected indirectly to the switch tongue by means of the switch tongue attachment, passes beneath the lower flange of the rail and thus establishes the mechanical frictional connection. In a locked position, the locking latch snaps directly onto the locking piece and is secured in its position fixedly by the slide rod. The switches are switched due to the movement of the slide rod. The open switch tongue begins to move first. After traveling the unlocking distance, the latch is pulled downward, thereby initiating the unlocking of the closed switch tongue. After being completely unlocked, both switch tongues simultaneously follow the movement of the slide rod until the previously open switch tongue is closed. When the slide rod is pulled further, the latch is raised into its locked position. The switch tongue, which is now open, moves further until the changeover operation is concluded and it is secured in this position.

The wheel flange exerts a force on the open switch tongue when driving over the switch. If the construction of the switch operating mechanism allows, the slide rod is moved and the closed switch tongue is unlocked before following the movement of the slide rod. In this way, the switches can be driven on at speeds of up to 40 km/h without any damage from the wrong side.

It is disadvantageous in all the known types of switch locks that relatively high actuating forces are necessary for control operations. Control operations may result in actuating force peaks which can even result in damage to the switch lock. In addition, the known types of switch locks are often very susceptible to longitudinal movements of the switches. Another disadvantage is that the known types of switch locks have very high service and maintenance requirements. Since the individual parts of the switch lock which are movable relative to one another can be displaced onto one another, constant high lubrication is necessary to permit displaceability with even low actuating forces. Finally, the known types of switch locks offer very little possibility of adjustment to permit adaptation to certain installation situations.

SUMMARY OF THE INVENTION

The object of the present invention is to make available a switch lock of the type defined in the preamble, wherein only low actuating forces, which are also essentially constant, are required, and wherein the maintenance and lubrication expenses are minimized.

The object defined above is achieved with a switch lock of the type defined in the preamble according to this invention with the characterizing features of claim 1. The design according to this invention differs greatly from the types of switch locks known in practice. Use of at least one bearing roller and direct or indirect rolling of the slide rod on the bearing roller leads at least essentially to only rolling friction occurring between the parts of the switch lock that can move relative to one another. Thus, in contrast with the state of the art, there is no sliding friction. As a result, the actuating forces required for control operations are not only relatively low but are also comparatively constant, so that the force peaks which occur in the prior art cannot occur here. In addition, the service and maintenance expense is very low due to the special design having the slide rod rolling directly or indirectly on the bearing roller. Constant lubrication over a large area is not necessary.

Although the design according to this invention can be implemented only in the area of a locking piece in the case of a switch lock, it is especially preferred for the invention to be implemented on both locking pieces of the switch lock. Accordingly, the following discussion with regard to the first or one locking piece should be understood to always also apply to the second or other locking piece, even if this is not mentioned specifically.

It is essentially possible to implement the special type of adjustment of the switch lock with a reduced switch tongue impact in comparison with the adjustment path of the slide rod by means of various movement possibilities and means or devices. In the embodiment according to this invention, the use of an angle lever for locking and/or adjusting the switch tongue which rolls on the bearing roller is preferred. To do so, the angle lever is connected in an articulated manner to both the slide rod and the switch tongue attachment. Indirect rolling of the slide rod on the bearing roller occurs by means of the angle lever which works directly with the bearing roller. Due to the articulated connection of the angle lever to the slide rod and to the switch tongue attachment, the switch lock according to this invention runs very smoothly and does not have any parts that slide against one another, except for the hinge switches of the angle lever and the bearing of the bearing roller. The angle lever is designed and connected in such a way that in adjustment of the slide rod, it pivots about the articulation point on the switch tongue attachment with its free end during locking or in the locked state of the switch tongue.

In this context, it is a special advantage that the angle lever has a first running surface of the rail facing downward on its free end, rolling on the bearing roller during locking. It is self-evident that unlocking proceeds in the same manner as locking, except in the opposite direction. Accordingly, the following discussion pertaining to locking also applies accordingly to the unlocking operation, although this may not be stated specifically in each case.

However, the angle lever is responsible not only for locking the switch tongue but also for controlling the actuating movement. Therefore, this provides specifically for the angle lever to run on the bearing roller with a second bearing surface which is provided on the angle lever during the adjustment of the switch tongue.

As a result, the angle lever thus has two bearing surfaces which control the entire movement process for locking and controlling the switch tongue.

To have a direct and continuous transition from locking to controlling, the first and second bearing surfaces change over directly one into the other. It is provided here that the two bearing surfaces are oriented at an angle of approximately 90° to one another in the area of transition.

In an especially preferred embodiment of the present invention, the second bearing surface, which controls the adjusting movement, is at an inclination. The second bearing surface is inclined, starting from the transition, so that the switch tongue is raised during the adjustment. This guarantees that the front slide plates of the switch or similar supports for the switch tongue need no longer be lubricated.

However, not only the individual movements during adjusting and locking can be controlled by the angle lever, but suitable limit stops may also be provided on the angle lever to limit the respective movement in adjusting and locking. Specifically, this invention provides for the fact that the bearing roller strikes in the leg area of the angle lever upon reaching the open end position of the switch tongue. This is especially important in manual operation of the switch lock; when motor driven, the stroke is usually determined by the drive. In addition, a projection is provided on the free end of the angle lever in the area of the end of the first bearing surface to act as a stop on reaching the maximum locking position.

To further minimize service and maintenance costs, pin joints with self-lubricating bushings are provided for the articulated connection of the angle lever to the switch tongue attachment and/or the slide rod. The bearing roller may also be mounted accordingly on the wear part by means of a self-lubricating bushing. The self-lubricating bushings make any personnel involvement in conjunction with lubrication unnecessary.

In another especially preferred embodiment of the present invention, the width of the bearing roller is preferably several times greater than the thickness of the angle lever. This makes a relative movement between the stock rail and the switch tongue and thus the angle lever on the bearing roller readily possible over a predetermined range in the longitudinal direction of the track without any negative effect on the function of the switch lock.

BRIEF DESCRIPTION OF THE DRAWINGS

In addition, it is also provided according to this invention that an adjusting device is assigned to the bearing roller, permitting an adjustment of the bearing roller in height and/or at a distance from the stock rail. The switch lock according to this invention can be readily adapted to a wide variety of installation situations by means of this adjusting device. Specifically, the adjusting device has a bearing fork on which the bearing roller is mounted. A mechanically secure type of adjustment which is easy to implement is guaranteed by means of spacer plates which are inserted or removed as needed in the area of the bearing fork.

As is customary in the prior art, a switch tongue impact of at least 150 mm with a control path of the slide rod of at least 200 mm can also be achieved by using the angle lever with the switch lock according to this invention. In addition, the slide rod can also be easily designed in such a way as to yield electric insulation between the stock rails.

Figure 1:
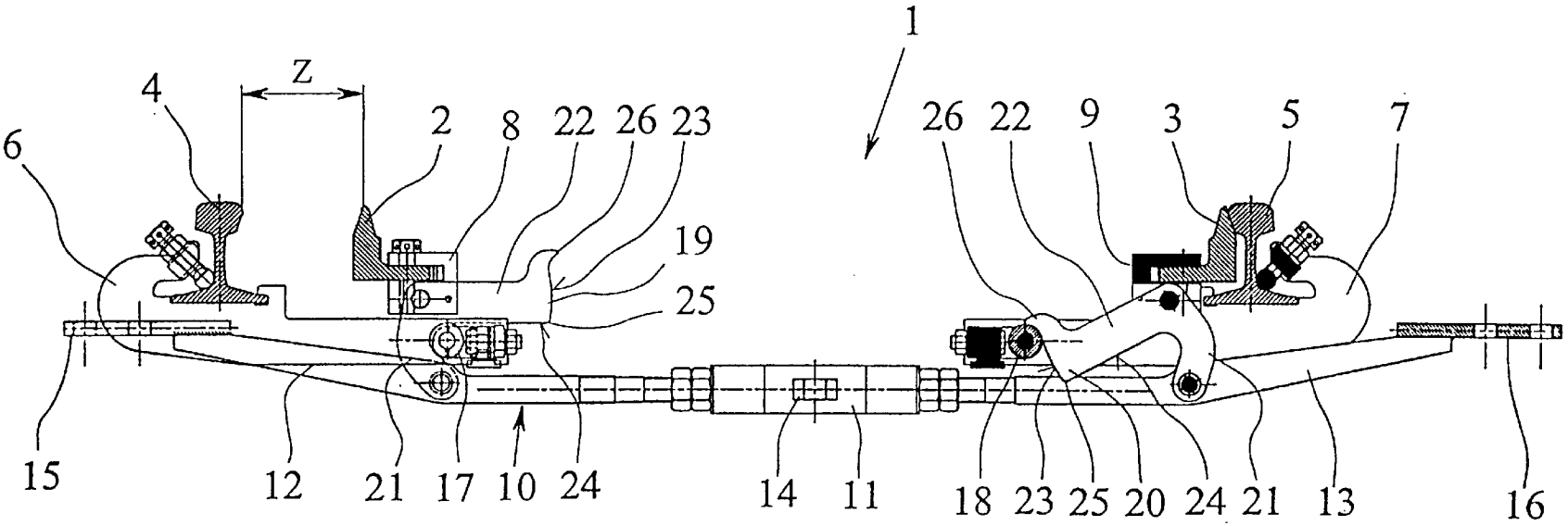
Figure 2:
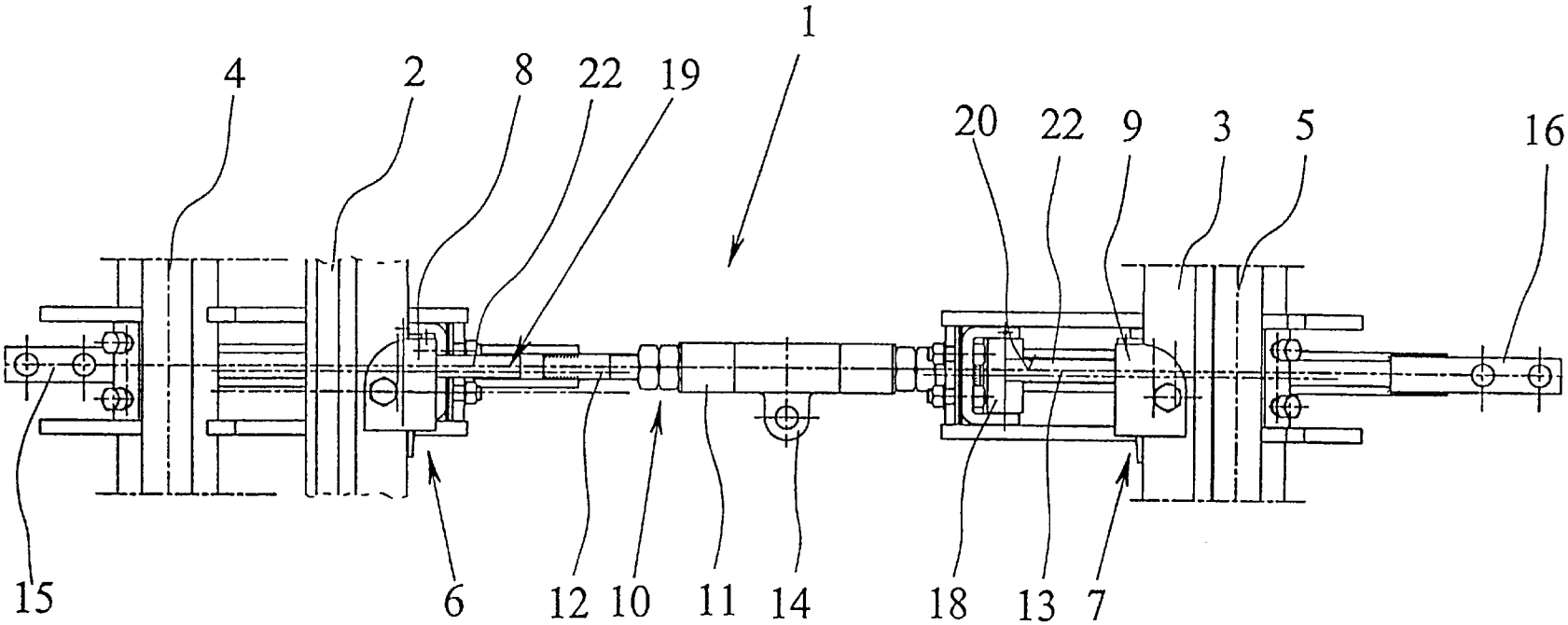
Figure 3:
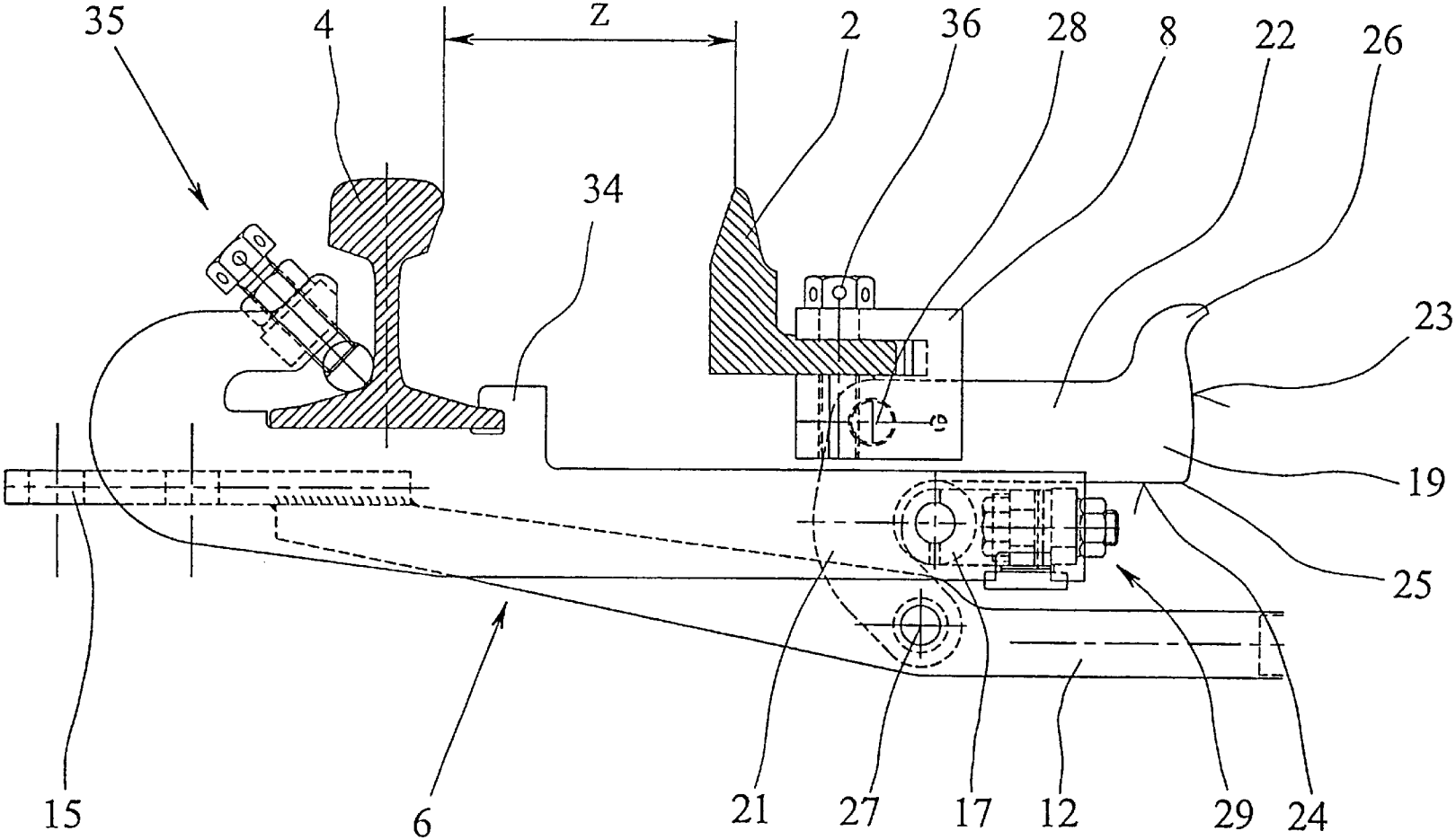
Figure 4:
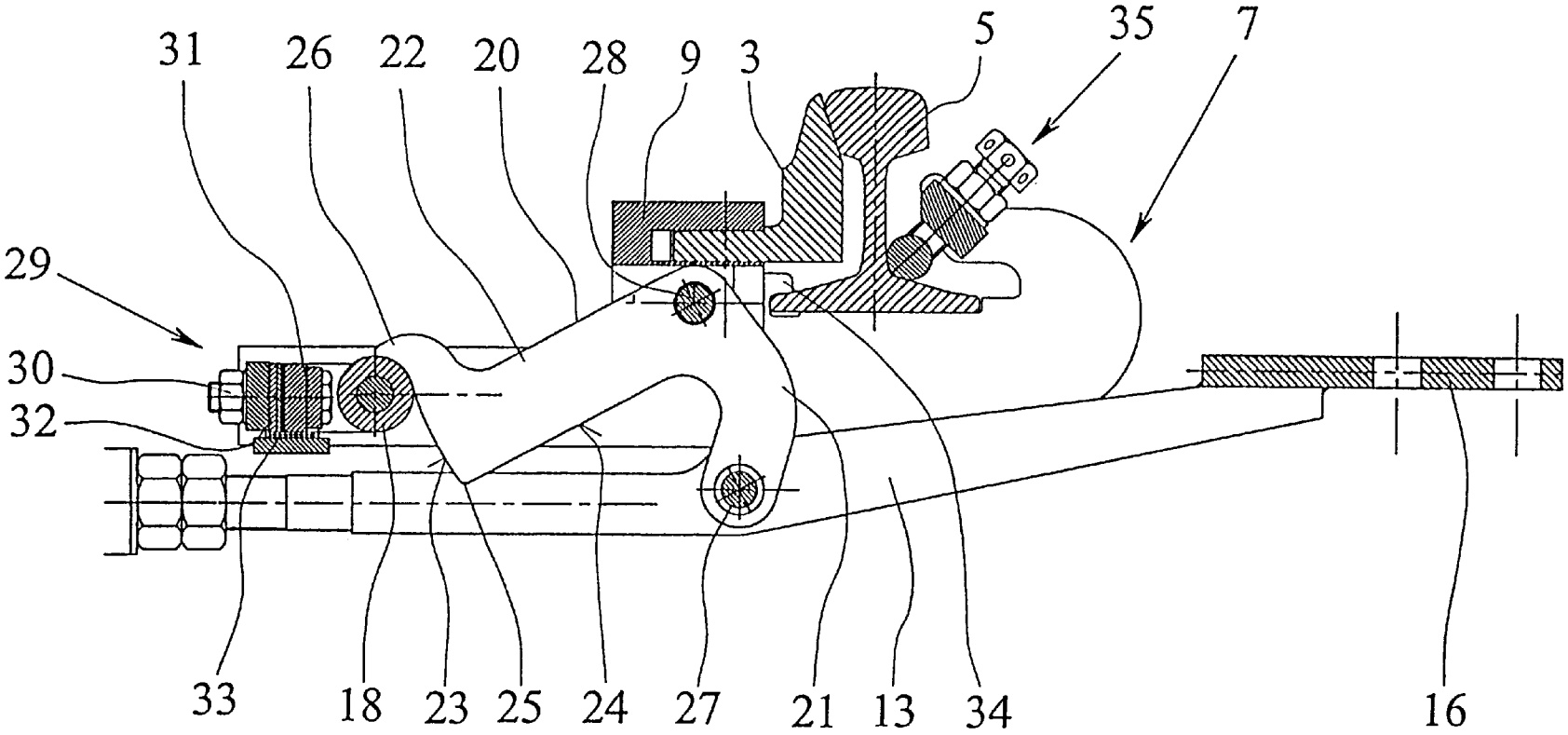
Figure 5:
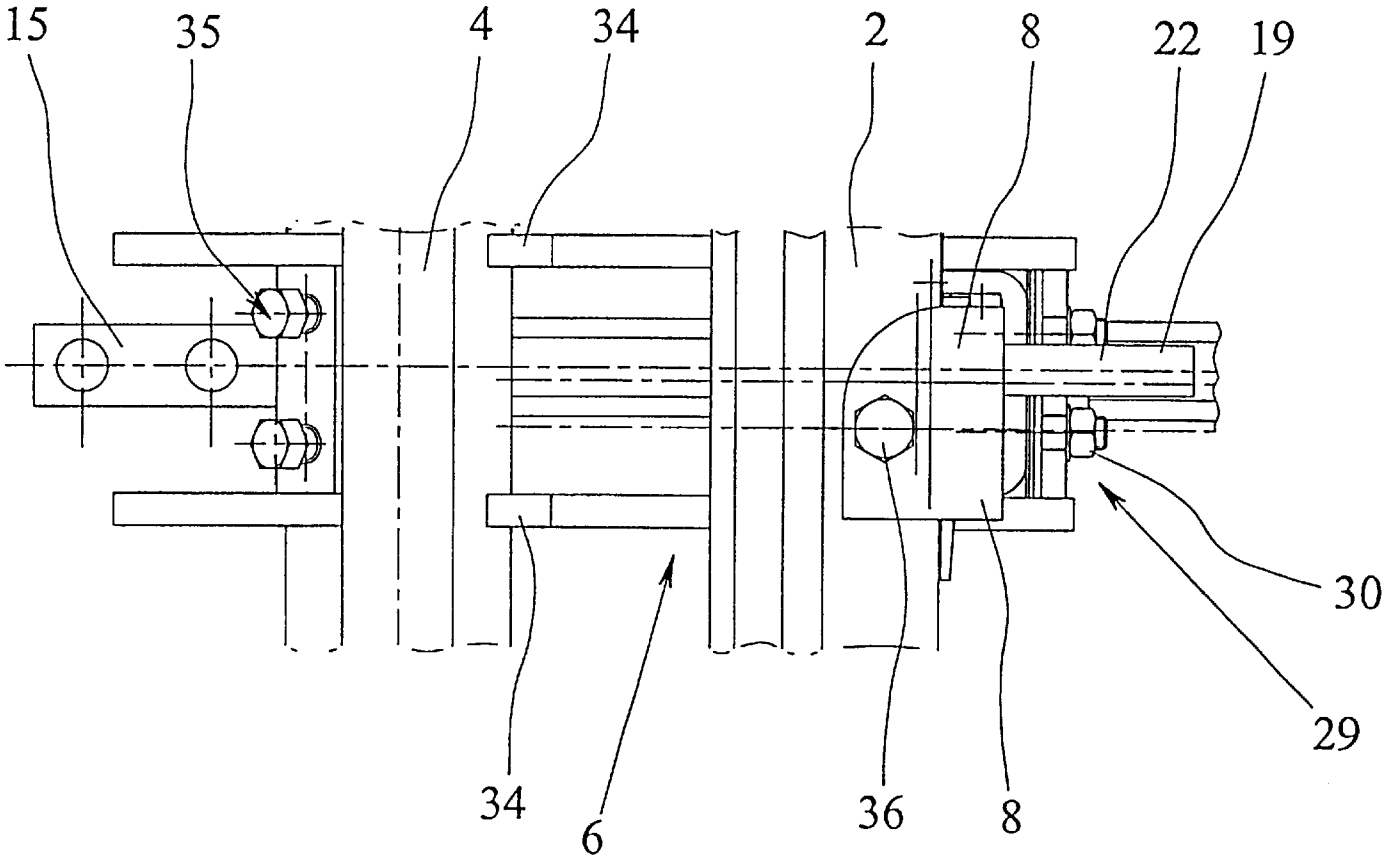
Figure 6:
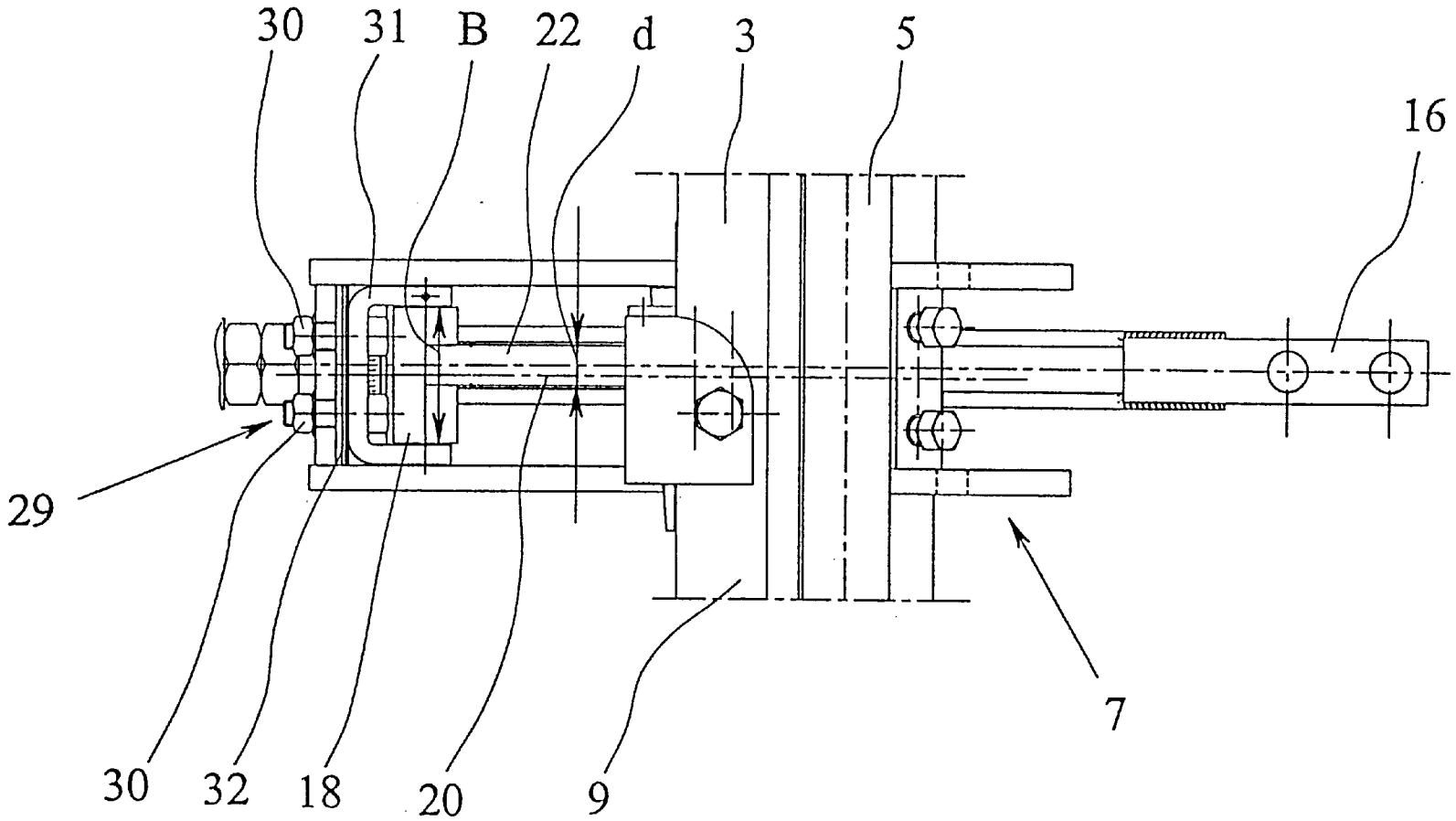

Embodiments of the present invention are described below on the basis of the drawings, which show:

FIG. 1: a view of a switch lock according to this invention in the installed position;

FIG. 2: a top view of the switch lock from FIG. 1;

FIG. 3: an enlarged view of the left portion of the switch lock from FIG. 1;

FIG. 4: an enlarged view of the right portion of the switch lock from FIG. 1 according to this invention;

FIG. 5: an enlarged view of the left portion of the switch lock from FIG. 2, and FIG. 6: an enlarged view of the right portion of the switch lock from FIG. 2.

DETAILED DESCRIPTION

FIGS. 1 and 2 show an overall view of a switch lock 1 according to this invention. This switch lock 1 operates a first and a second switch tongue 2, 3 between a first and a second stock rail 4, 5 in the changeover operation. The switch lock 1 has a first and a second locking piece 6, 7, each being attached to the first or second stock rail 4, 5. In addition, the switch lock 1 has a first and a second switch tongue attachment 8, 9, each serving for attachment to the first or second switch tongue 2, 3. In addition, the switch lock 1 is provided with a slide rod 10. The slide rod 10 is designed in several parts and has a middle part 11 and two outer slide rod parts 12, 13. Working sections 14, 15, 16 are provided on the middle part 11 as well as on the outer slide rod parts 12, 13 for connection to a drive (not shown).

As is customary with switch lock in general, the adjustment path of the slide rod 10 with the switch lock 1 according to this invention is also greater than the switch tongue impact Z of the switch tongues 2, 3.

The first switch tongue 2 shown in the left portion of FIGS. 1 and 2 is in its open end position, while the second switch tongue 3 shown in the right portion of FIGS. 1 and 2 is in its closed or locked end position, i.e., it is locked on the second stock rail 5.

It is essential that at least one bearing roller 17, 18 is provided on each of the locking pieces 6, 7 and that the slide rod 10 can move relative to the locking pieces 6, 7 by means of the respective bearing rollers 17, 18 for adjustment of the switch tongues 2, 3. However, the slide rod 10 does not roll directly on the bearing rollers 17, 18, but instead it rolls only indirectly. Therefore, an angle lever 19, 20 provided on each of the locking pieces 6, 7 serves to lock and adjust the respective switch tongue 2, 3 and works together with the respective bearing roller 17, 18. Each of the angle levers 19, 20 therefore rolls on the respective bearing roller 17, 18. In addition, each of the angle levers 19, 20 is connected in an articulated manner to both the slide rod 10 and the respective switch tongue attachment 8, 9. Specifically, the first angle lever 19 is connected to the outer slide rod part 12 and the first switch tongue attachment 8, namely with its angle leg 21.

The second angle lever 20 is connected to the second switch tongue attachment 9 and to the outer slide rod part 13, likewise by means of angle leg 21. A free angle leg 22 is bent away from angle leg 21, with the two angle levers 19, 20 being arranged relative to one another so that the free angle legs 22 point toward each other. The articulated connection of the two angle levers 19, 20 is such that the angle leg 21 is connected to the slide rod 10 on its free outer end. The other articulation point of the respective angle lever is located at the bend in the angle lever, i.e., in the crown area or at the transition from one angle leg 21 to the other angle leg 22. Moreover, in the present case it is such that angle leg 21 is shorter than angle leg 22.

The articulated connection and the design of the two angle levers 19, 20 are such that the angle levers 19, 20 pivot about the connection point on the respective switch tongue attachment in adjustment of the slide rod 10 with its respective free end, i.e., with the free angle leg 22 during the locking of the respective switch tongue. To be able to execute the desired movement in locking or during the locked state, on the end of the free angle leg 22 each of the angle levers 19, 20 has a first running surface 23 facing downward and rolling on the respective bearing roller 17, 18 during the locking. In addition, the free angle leg 22 has a second running surface 24 on its lower side which rolls on the respective bearing roller 17, 18 during adjustment of the respective switch tongue 2, 3 in adjustment of the slide rod 10. The two running surfaces 23, 24 are thus control surfaces by means of which the movements during the adjustment and locking operations are controlled.

As shown especially in FIGS. 3 and 4, the first and second running surfaces 23, 24 develop directly one into the other and are oriented approximately at right angles to one another in the area of the transition 25. This does not show that the second running surface 24 may be arranged at an inclination, starting from the transition 25, such that the respective switch tongue 2, 3 is raised during the adjustment. As shown especially in FIG. 3, on reaching the open end position of the switch tongue 2, 3, the respective bearing roller strikes the angle leg 21 of the angle lever 19, 20, so that the angle leg 21 functions as a stop to limit the control path during the adjustment. In addition, a projection 26 pointing in the direction of the respective bearing roller 17, 18 in the locked position is provided on the free end of the angle leg 22, serving as a stop upon reaching the maximum locked position.

Pin joints 27, 28 with self-lubricating bushings are provided on each switch tongue attachment 8, 9 and on the slide rod 10 for hinge connection of the respective angle lever 19, 20. The two bearing rollers 17, 18 are also mounted on the locking parts 6, 7 by means of self-lubricating bushings.

As shown especially in FIG. 6, the width B of the respective bearing roller 17, 18 is several times larger than the thickness d of the respective angle lever 19, 20, so that movement of the respective switch tongue relative to the respective stock rail and thus the respective angle lever 19, 20 along the width of the respective bearing roller 17, 18 is readily possible.

It can be seen especially from FIGS. 3 through 6 that each of the bearing rollers 17, 18 has an adjustment device 29 for adjusting the respective bearing roller 17, 18 in height and/or at a distance from the respective stock rail 4, 5. The adjusting device 29 has a bearing fork 31 connected by screw connections 30 to the respective locking piece 6, 7, with the respective bearing roller 17, 18 mounted on this bearing fork. Spacer plates 32 for adjusting the space and space plates 33 for adjusting the height are arranged between the respective locking piece 6, 7 and the bearing fork 31.

Assembly of the switch lock 1 according to this invention is readily possible in the area of switches. First the locking pieces 6, 7, each of which has a box-shaped design, are attached to the respective stock rail 4, 5. Each of the locking pieces 6, 7 therefore has a projection 34 with a receiving groove for the base of the stock rail. Corresponding bracing means 35 for bracing on the respective stock rail 4, 5 are provided on the opposite side. Since the slide rod 10 is designed in multiple parts, each locking piece 6, 7 can be assembled separately. Then the respective switch tongue attachments 8, 9 are attached to the switch tongues 2, 3 and bolted by appropriate screw means 36. Then the slide rod 10 is optionally assembled. Next, fine adjustment is performed by means of the adjusting device 29, i.e., by means of the spacer plates 32. Finally, the connection is accomplished by one or more of the working sections 14, 15, 16 on a drive.

Then, if a force is applied by the drive to the slide rod 10, the adjusting motion takes place as follows, starting from the locked position illustrated in FIG. 4.

Due to the movement of the slide rod 10 to the left, the angle lever 21 pivots clockwise and the pin joint 27 also moves to the left. The free angle leg 22 pivots upward about the pin joint 28 along the first running surface 23 until reaching the transition 25. Up to this point, switch tongue 3 still has not moved away from the stock rail 5, while switch tongue 2 has already moved in the direction of the stock rail 4. Further movement of the slide rod 10 to the left results in the second running surface 24 rolling on the bearing roller 18. Lifting of switch tongue 3 may be provided if the second running surface 24 is inclined accordingly. The movement along the second running surface 24 takes place until the bearing roller 18 strikes the angle leg 21 on the inside. Then the open end position of switch tongue 3 is reached, as shown for switch tongue 3 in FIG. 3. Switch tongue 2, however, is in the locked position.

Switch tongue 3 is reset in the opposite direction, with an at least essentially horizontal movement again taking place along the second running surface 24 until the bearing roller 18 moves over to the first bearing surface 23. In this state, switch tongue 3 is in contact with the stock rail 5. Then, the locking operation takes place, with the bearing roller 18 rolling on the first running surface 23 until the projection 26 strikes the bearing roller 18 as a stop. No further movement is possible.

Moreover, it is self-evident that the movement described in detail for the second locking piece 7 takes place accordingly on the first locking piece 6 with a corresponding movement of the slide rod 10, although this is not mentioned in detail.

What is claimed is:

1. A switch lock for operating switch tongues between stock rails in a changeover operation comprising:

at least one locking piece that attaches to the stock rail;

at least one switch tongue attachment that attaches to the switch tongue;

a slide rod having an adjustment distance greater than a switch tongue extension of the switch tongue, wherein the switch tongue is locked on the stock rail in a locked position;

at least one bearing roller disposed on said at least one locking piece, permitting said slide rod to move relative to said at least one locking piece to adjust the switch tongue;

an angle lever coupled to said slide rod via a pin joint and coupled to said at least one switch tongue attachment via a pin joint, wherein said angle lever has a free end, and wherein said angle lever rolls on said at least one bearing roller;

wherein said angle lever works with said at least one bearing roller to lock and adjust the switch tongue so that said angle lever pivots with said free end about an articulation point on said a: least one switch tongue attachment in adjusting said slide rod in said locked position.

2. Switch lock according to claim 1, wherein said angle lever has a first running surface on its free end which rolls on said bearing roller while in said locked position.

3. Switch lock according to claim 2, wherein said angle lever has a second running surface that rolls on said bearing roller during the adjustment of the switch tongue.

4. Switch lock according to claim 3, wherein said first running surface and said second running surface of said angle lever preferably change directly over into one another, and are preferably arranged at an angle of approximately 90° to one another in a first transition area.

5. Switch lock according to claim 4, wherein said second running surface is inclined at an angle, beginning at said first transition area, so that the switch tongue is raised during adjustment.

6. Switch lock according to claim 2, further comprising a projection disposed on said free end of said angle lever or an end of said first running surface, wherein said projection functions as a stop upon reaching said locked position.

7. Switch lock according to claim 4, wherein upon reaching an open end position of the switch tongue said bearing roller strikes a leg area of said angle lever.

8. Switch lock according to claim 1, wherein said pin joints have self-lubricating bushings provided on the switch tongue attachment and on said slide rod for the articulated connection of said angle lever.

9. Switch lock according to claim 1, wherein said bearing roller is mounted on a self-lubricating bushing on said at least one locking piece.

10. Switch lock according to claim 1, wherein a width of said bearing roller is preferably several times greater than a thickness of said angle lever.

11. Switch lock according to claim 1, wherein said bearing roller has an adjustment device for adjusting said bearing roller in height and in distance from the stock rail said adjusting device preferably has a bearing fork on which said bearing roller is mounted, and said bearing fork is preferably adjustable by means of spacer plates.

12. Switch lock according to claim 1, wherein said switch tongue extension is at least 150 mm and the adjustment distance of said slide rod is at least 200 mm.

* * * * *